US006402591B1

(12) United States Patent
Thornton

(10) Patent No.: US 6,402,591 B1
(45) Date of Patent: Jun. 11, 2002

(54) PLANARIZATION SYSTEM FOR CHEMICAL-MECHANICAL POLISHING

(75) Inventor: Brian Thornton, Santa Clara, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/539,397

(22) Filed: Mar. 31, 2000

(51) Int. Cl.[7] ..... B24B 1/00

(52) U.S. Cl. ..... 451/36; 451/41; 451/63; 451/288

(58) Field of Search ..... 451/41, 63, 60, 451/288, 287, 270

(56) References Cited

U.S. PATENT DOCUMENTS

| | | | | |
|---|---|---|---|---|
| 3,753,269 A | | 8/1973 | Budman | |
| 3,863,395 A | * | 2/1975 | Brown | 51/121 |
| 4,318,250 A | | 3/1982 | Klievoneit et al. | |
| 4,720,939 A | | 1/1988 | Simpson et al. | |
| 4,934,102 A | | 6/1990 | Leach et al. | |
| 5,081,051 A | | 1/1992 | Mattingly et al. | |
| 5,212,910 A | * | 5/1993 | Breivogel et al. | 51/398 |
| 5,335,453 A | | 8/1994 | Baldy et al. | |
| 5,536,202 A | | 7/1996 | Appel et al. | |
| 5,575,707 A | | 11/1996 | Talieh et al. | |
| 5,593,344 A | | 1/1997 | Weldon et al. | |
| 5,611,943 A | | 3/1997 | Cadien et al. | |
| 5,622,526 A | | 4/1997 | Phillips | |
| 5,643,044 A | | 7/1997 | Lund | |

(List continued on next page.)

FOREIGN PATENT DOCUMENTS

| | | | | |
|---|---|---|---|---|
| JP | 9-63995 | * | 3/1997 | B24B/37/00 |
| JP | 10-156705 | * | 6/1998 | B24B/37/00 |
| WO | WO 99/06182 | | 2/1999 | |

OTHER PUBLICATIONS

S. Inaba, T. Katsuyama, M. Tanaka, "Study of CMP Polishing pad Control Method," 1998 CMP–MIC Conference, Feb. 19–20, 1998, 1998 IMIC–300P/98/0444.

U.S. patent application Ser. No. 09/386,741: "Unsupported Chemical Mechanical Polishing Belt"; Inventors: Xu et al.; Filed: Aug. 31, 1999; Attorney Docket No. 7103–83.

U.S. patent application Ser. No. 09/540,810: "Fixed Abrasive Linear Polishing Belt and System"; Inventors: Zhao et al.; Filed Mar. 31, 2000; Attorney Docket No. 7103–135.

U.S. patent application Ser. No. 09/757,452: "Chemical Mechanical Planarization Belt Assembly and Method of Assembly"; Inventors: Lacy et al.; Filed Jan. 9, 2001; Attorney Docket No. 7103–191.

*Primary Examiner*—Derris H. Banks
*Assistant Examiner*—David B Thomas
(74) *Attorney, Agent, or Firm*—Brinks Hofer Gilson & Lione; Anastaia Heffner

(57) ABSTRACT

A method for performing and an apparatus to perform chemical mechanical polishing on a semiconductor wafer are disclosed. The apparatus includes a wafer holder, a polishing member, and a movable table. The movable table is in contact with and is supporting the polishing member. The polishing member includes a polishing pad, a backing layer, and a stiffening layer positioned between the backing layer and the polishing pad. The polishing pad has a polishing surface that is oriented to receive a semiconductor wafer held by the wafer holder. The polishing surface is configured to chemically mechanically polish the semiconductor wafer. The method includes holding a semiconductor wafer, moving a polishing member, and bringing a surface of the semiconductor wafer into contact with the polishing member. The polishing member includes a polishing pad, a backing layer, and a stiffening layer positioned between the polishing pad and the backing layer.

32 Claims, 2 Drawing Sheets

U.S. PATENT DOCUMENTS 5,655,951 A 8/1997 Meikle et al.
5,664,989 A * 9/1997 Nakata et al. ..... 451/41
5,692,947 A 12/1997 Talieh et al.
5,735,731 A * 4/1998 Lee ..... 451/143
5,759,918 A 6/1998 Hoshizaki et al.
5,779,526 A 7/1998 Gill
5,871,390 A 2/1999 Pant et al.
5,897,426 A * 4/1999 Somekh ..... 451/41
5,899,798 A 5/1999 Trojan et al.
5,981,396 A * 11/1999 Robinson et al. ..... 438/692
6,116,998 A * 9/2000 Damgaard et al. ..... 451/490
6,123,609 A * 9/2000 Satou ..... 451/285
6,162,368 A * 12/2000 Li et al. ..... 216/89

* cited by examiner

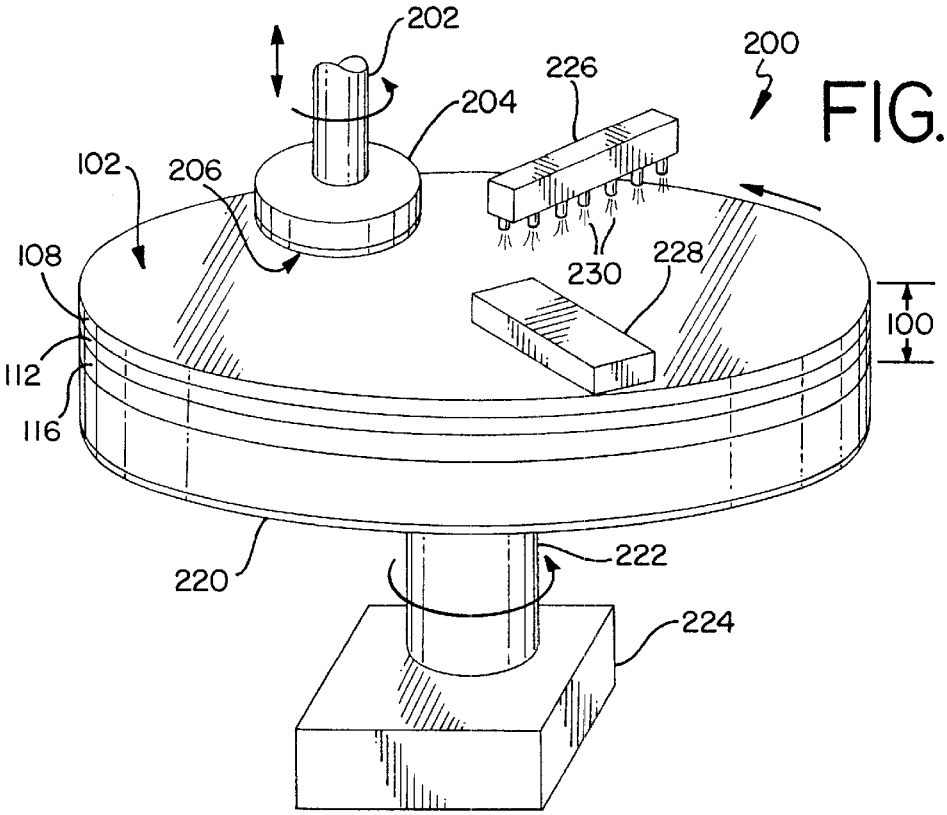
FIG. 2
FIG. 3
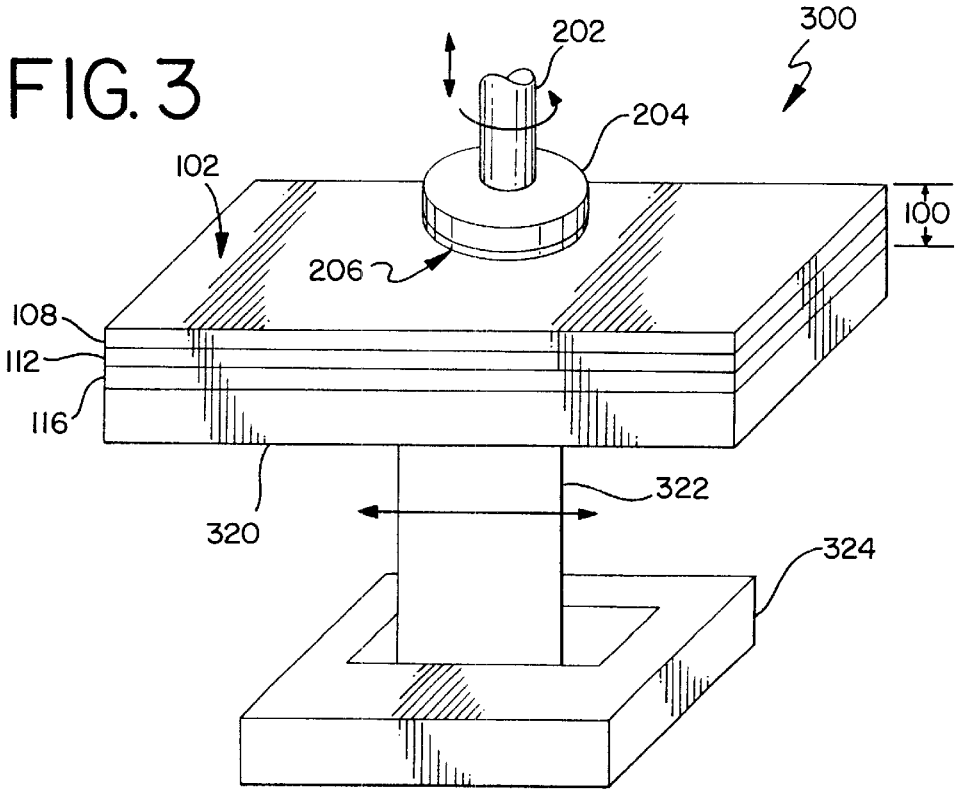

PLANARIZATION SYSTEM FOR CHEMICAL-MECHANICAL POLISHING

FIELD OF THE INVENTION

The present invention relates to the field of chemical mechanical polishing/planarization (CMP). More particularly, the present invention relates to a CMP tool, used in semiconductor manufacturing, having the ability to improve the planarization ability of a CMP machine while maintaining uniformity of material removal across the wafer.

BACKGROUND

Semiconductor wafers are typically fabricated with multiple copies of a desired integrated circuit design that will later be separated and made into individual integrated circuit chips. A common technique for forming the circuitry on a semiconductor is photolithography. Part of the photolithographic process requires that a special camera focus on the wafer to project an image of the circuit on the wafer. The ability of the camera to focus on the surface of the wafer is often adversely affected by inconsistencies or unevenness in the wafer surface. The need for a precise image projection is accentuated with the current drive toward smaller, more complex integrated circuit (IC) designs.

In modern IC fabrication technology, it is presently necessary to form various embedded structures over previous material layers of integrated circuits formed on semiconductor wafers. Integrated circuits on semiconductor wafers are also commonly constructed in layers. Each layer of the circuit can create or add unevenness to the wafer as it is constructed. Slight irregularities on the wafer surface—or on deposited films—can distort semiconductor patterns as lithographic equipment and processes transfer these patterns to the wafer surface. For this reason, during the manufacturing process, certain portions of these material layers typically require complete or partial removal to achieve the desired device structure on the wafer. Any imperfections are preferably smoothed out before generating the next circuit layer.

Chemical mechanical polishing/planarization (CMP) has become a popular method to achieve this material removal and to prevent distortion. CMP techniques are used to planarize the raw wafer and each layer of material added thereafter to a flat, uniform finish. Available CMP systems, commonly called wafer polishers, often use a rotating wafer holder that brings the wafer into contact with a polishing pad that is moving in the plane of the wafer surface to be planarized. Typically, a polishing fluid, such as a chemical polishing agent or slurry containing microabrasives, is applied to the polishing pad to polish and planarize the surface of the wafer. The wafer holder then presses the wafer against the rotating polishing pad and is rotated to polish and planarize the wafer.

The polishing pads commonly used in this process include both belt-type pads and rotary-type pads. A belt-type pad typically consists of one or more sections of material that are joined together through lamination or the like to form a belt. The belt is placed around a plurality of rollers that cause the belt to rotate. A rotary-type pad typically consists of one or more sections of material that are joined together to form a pad. The pad is attached to a rotary machine that rotates the pad to polish a wafer.

Typical wafer polishing machines and processes are highly sensitive to the density of structures underlying the layer being polished. For example, the wafer polishing machines and processes typically exhibit high material removal rates in sparse areas and relatively low material removal rates in dense areas. The resulting variation in film thickness across the dies degrades device performance and limits the ability to continue stacking additional layers on the wafers during fabrication processes. Accordingly, polishing machines and processes that overcome these deficiencies are needed.

It would be desirable to improve the planarization performance of CMP polishers while maintaining a desirable level of uniformity of material removal across the entire wafer.

BRIEF DESCRIPTION OF DRAWINGS

FIG. 2 is a simplified perspective view of an exemplary rotary polisher with a polishing member according to a first presently preferred embodiment;

FIG. 3 is a simplified perspective view of an exemplary linearly reciprocating polisher with a polishing member according to a second presently preferred embodiment.

DETAILED DESCRIPTION OF PRESENTLY PREFERRED EMBODIMENTS

By way of introduction, Lam Research Corporation of Fremont, Calif. recently developed an approach for improving the ability of CMP machines to planarize the topography that results from the addition of material layers in the semiconductor manufacturing process. Attempts to address the challenges of planarization and polish uniformity have included using a harder polishing pad to polish the surface of the wafer and remove the material. While using a harder pad often improves planarization over the die, the trade-off is that the non-uniformity of material removal across the wafer is increased. Thus, the generally accepted approach has been to affix or otherwise stack a harder polishing pad on a softer polishing pad. This combination of a hard and a soft pad yields a compromise between material removal uniformity and planarization performance.

In order to address the need for a wafer polisher capable of improved operation to provide a better compromise between planarization and polish uniformity of a wafer undergoing a polishing operation, such as chemical mechanical polishing, several embodiments for performing improved wafer polishing operations are described herein.

Figure 1:
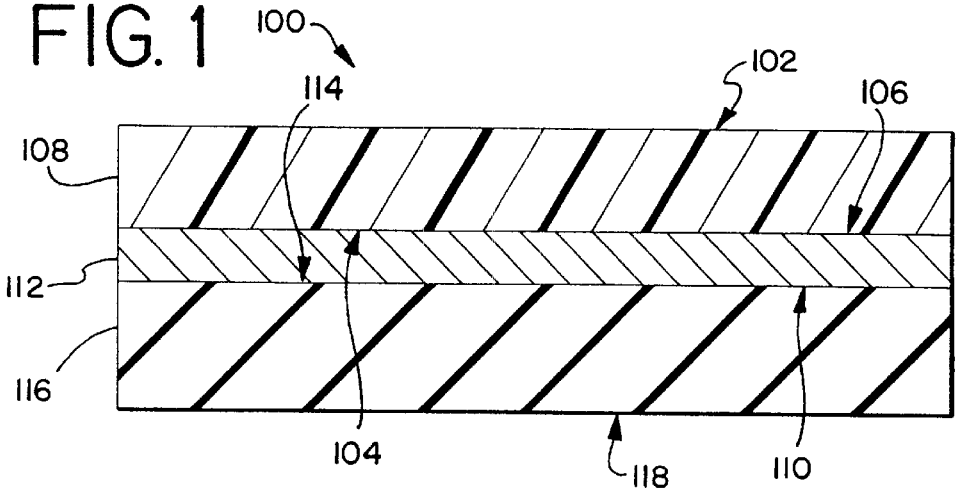
FIG. 1 is a cross-sectional side view of an exemplary polishing member according to a presently preferred embodiment.

Referring to FIG. 1, it is a cross-sectional side view of an exemplary polishing member 100 according to a presently preferred embodiment. Preferably, the polishing member 100 performs or is utilized to perform chemical mechanical polishing on a wafer, for example, a semiconductor wafer. The polishing member 100 includes a polishing pad 108, a stiffening layer 112, and an under layer or backing layer 116. Preferably, the stiffening layer 112 is positioned between the polishing pad 108 and the backing layer 116. The polishing pad 108 has a polishing surface 102 and a back side 104. Thus, the polishing member 100 can be said to have a polishing surface 102 as well. The stiffening layer 112 has a first side 106 and a second side 110. The first side 106 of the stiffening layer 112 is attached to the back side 104 of the polishing pad 108. The backing layer 116 has a front side 114 and a base side 118. The front side 114 of the backing layer 116 is attached to the second side 110 of the stiffening layer 112.

The adhesion, or more broadly, the attachment between the polishing pad 108, the stiffening layer 112, and the backing layer 116 is an important consideration in implementing the polishing member 100 in chemical mechanical polishing/planarization (CMP). The polishing member 100 can be formed using adhesives or by more intensive fabrication and molding processes. For example, the polishing pad 108, the stiffening layer 112, and the backing layer 116 can be attached and molded together to form a unitary piece. The polishing member 100 can also be constructed from several separate parts. Any of the separate parts could be replaced in the event of wear, for example. Preferably, adhesives are used to construct the polishing member 100. According to FIG. 1, a first adhesive is used to combine the stiffening layer 112 and the polishing pad 108. The first side 106 of the stiffening layer 112 is attached to the back side 104 of the polishing pad 108 with the first adhesive. A second adhesive is used to combine the stiffening layer 112 and the backing layer 116. The front side 114 of the backing layer 116 is attached to the second side 110 of the stiffening layer 112 with the second adhesive.

Different adhesive compounds may be used for the first and second adhesives. In a typical CMP process, a polishing pad such as polishing pad 108 wears out and is replaced. In a preferred embodiment, the second adhesive is more permanent than the first adhesive that combines the polishing pad 108 and the stiffening layer 112.

During different steps of a wafer polishing process, certain chemical agents may react with one or both of the adhesives. For example, to polish a Tungsten layer, a low pH or acidic slurry is typically used. With an oxide, such as $SiO_2$, layer polish, a high pH or basic slurry is typically used. Preferably, to prevent the adhesives from reacting with the slurries or other chemical agents, different adhesives are used in different wafer processing steps as required for different applications.

The polishing pad 108 preferably is a polyurethane based material such as IC1000 available from Rodel Corporation. Alternatively, the polishing pad 108 can include any suitable polishing pad material. Some other examples of polishing pads are Suba IV, Suba 500, and IC-60, also available from Rodel Corporation, although this list is far from exhaustive and a wide variety of polishing pads may be used. If the polishing pad 108 is a separate component, the pad 108 may come with the first adhesive already attached to the back side 104. The polishing pad 108 often includes a standard glue or laminate on the back side 104 that is used to attach the pad 108 to a supporting structure. In this way, the polishing pad 108 and the first adhesive can be said to form a unitary piece. In presently preferred embodiments described herein, the standard glue serves as the first adhesive and is used to attach the polishing pad 108 to the stiffening layer 112.

The stiffening layer 112 is not restricted to any particular material, although the material will generally be stiffer and less compliant than the other elements of the polishing member 100. In an exemplary embodiment, the stiffening layer 112 could be a thin metal, for example, stainless steel at a sheet thickness of 0.02 inches. It should be understood that any other suitable materials and metals, such as aluminum or titanium, as well as other suitable thicknesses, could be utilized for the stiffening layer 112. The choice of material will in general depend in part on the material selected for the backing layer 116 and possibly the polishing pad 108.

Similarly, the backing layer 116 is not restricted to any particular material, although the material will generally be somewhat elastic and more compliant than the other elements of the polishing member 100. In an exemplary embodiment, the backing layer 116 could be a standard nitrile rubber material such as Buna-N, having a somewhat low hardness of about 40 durometer. Another example of a backing layer material is Suba IV also available from Rodel Corporation. Of course, there are a wide variety of suitable materials that could be used for the backing layer 116. The choice of material will in general depend in part on the material selected for the stiffening layer 112 and possibly the polishing pad 108.

The relative compliances of the polishing pad 108, the stiffening layer 112, and the backing layer 116 of the polishing member 100 are another important consideration in implementing the polishing member 100 in chemical mechanical polishing/planarization (CMP). For example, the stiffening layer 112 is introduced to provide a stiffer and less compliant polishing member for performing CMP. Preferably, a compliance of the backing layer 116 exceeds a compliance of the stiffening layer 112. Preferably, a compliance of the polishing pad 108 exceeds a compliance of the stiffening layer 112. Further, a compliance of the backing layer 116 preferably exceeds a compliance of the polishing pad 108. In a presently preferred embodiment of the polishing member 100, a compliance of the backing layer 116 exceeds a compliance of the polishing pad 108, while a compliance of the polishing pad 108 exceeds a compliance of the stiffening layer 112.

The relative thicknesses of the various layers are an important factor as well, since there is often an interplay between the compliance of a layer and its thickness. For the polishing pad 108 and the backing layer 116, the primary stiffness component is material compression. Generally, the greater the thickness of the polishing pad 108 or the backing layer 116, the more compliant the pad 108 or the layer 116 will be. For the stiffening layer 112, the primary contribution to the stiffness of the polishing member 100 is through bending or flexure of the stiffening layer 112. Generally, the greater the thickness of the stiffening layer 112, the less compliant the layer 112 will be. Generally, the thicknesses and the material properties of the layers should be such that in an embodiment of the polishing member 100, a compliance of the backing layer 116 exceeds a compliance of the polishing pad 108, while a compliance of the polishing pad 108 exceeds a compliance of the stiffening layer 112. For example, a stiffening layer 112 having a high modulus of elasticity compared with that of the backing layer 116 and having a layer 112 thickness that is less than a layer 116 thickness would be less compliant than the backing layer 116. Conversely, a backing layer 116 having a substantially lower modulus of elasticity compared with the stiffening layer 112 and having a layer 116 thickness that is less than a layer 112 thickness would be more compliant than the stiffening layer 112.

Preferably, the polishing member 100 performs or is utilized to perform chemical mechanical polishing on a wafer, for example, a semiconductor wafer. Accordingly, a presently preferred method and apparatus and accompanying embodiments to perform chemical polishing on a wafer are disclosed and presented. Of course, the polishing member 100 can be constructed and implemented in several ways. Generally, however, the polishing surface 102 of the polishing pad 108 and thus the polishing member 100 is configured to move against a surface of a wafer to remove impurities and materials on the surface of the wafer and to planarize the surface of the wafer while approaching a uniform polish over the surface of the wafer. The polishing surface 102 is oriented to receive a wafer and is configured to chemically mechanically polish and planarize the wafer.

The degree of abrasiveness of the polishing surface 102 of the polishing pad 108 and the polishing member 100 is another important consideration in implementing the polishing member 100 in chemical mechanical polishing/planarization (CMP). Preferably, the polishing surface 102 is substantially non-abrasive. For example, the polishing surface 102 can be utilized to perform CMP on a wafer in the presence of abrasives contained in a chemical slurry. In this instance, the polishing surface 102 might be substantially non-abrasive in character but may be abraded during pad conditioning during CMP. In other embodiments, the polishing pad 108 is a fixed abrasive pad. That is, any abrasive nature of the polishing surface 102 during CMP is due to the intrinsic character and design of the polishing pad 108. For example, the polishing pad 108 may have an abrasive polishing surface 102 notwithstanding the application of any chemical agent or fluid. In the case of a fixed abrasive pad, a chemical agent or a fluid, substantially non-abrasive or otherwise, may be applied for lubrication and chemical reaction with the polish surface. In the case of using a fixed abrasive in an oxide, for example $SiO_2$, layer polishing step, for example, a basic or high ph buffered solution may be added to accelerate the hydrolization of the polishing surface which contributes to exemplary improved polishing.

Referring now to FIG. 2, it is a simplified perspective view of an exemplary rotary polisher 200 with a polishing member 100 according to a first presently preferred embodiment. The rotary polisher 200 may be constructed using an existing rotary polisher, such as one available from Applied Materials of Santa Clara, Calif., modified to include a polishing member 100 as described above to increase uniformity of the wafer polishing as described herein. The rotary polisher 200 includes the polishing member 100, a wafer holder 204, a wafer holder axle 202, a movable table 220, a table support axle 222, a base 224 that serves as a housing for the table support axle 222, a dispenser 226, and a pad conditioner 228. The polishing member 100, as described above, includes a polishing pad 108, a stiffening layer 112, and a backing layer 116. The wafer holder 204 is configured to hold a wafer 206. The dispenser 226 preferably dispenses a chemical agent or a fluid 230, such as a chemical slurry containing abrasives. The movable table 220 is in contact with the polishing member 100 and supports the polishing member 100. Preferably, the movable table 220 is attached to or is in immediate contact with the backing layer 116 of the polishing member 100. Typically, the surface area of the movable table 220 exceeds the surface area of the wafer holder 204.

Preferably, the movable table 220 of FIG. 2 is actively or passively rotatable. In FIG. 2, the axis of rotation of the movable table 220 is located at the center of the table. In another embodiment, the movable table 220 is rotary and has an axis of rotation removed from the center of the movable table 220.

The dispenser 226 and the pad conditioner 228 are shown in FIG. 2. The dispenser 226 is suspended proximally to the polishing surface 102 of the polishing pad 108 and the polishing member 100. The dispenser 226 is configured to dispense or distribute a fluid 230 over the polishing surface 102 to facilitate chemical mechanical planarization/polishing of the wafer 206. Preferably, the fluid 230 includes abrasives contained in a chemical slurry. Preferably, the abrasive particles, or microabrasives, contained in the chemical slurry are utilized to chemically mechanically polish and planarize the wafer 206. Of course, in other embodiments such as those with a fixed abrasive polishing pad 108, the fluid 230 may be substantially non-abrasive. The pad conditioner 228 is suspended proximally to the polishing surface 102 of the polishing pad 108 and the polishing member 100. The pad conditioner is configured to condition the polishing surface 102 for improved fluid 230 entrainment. As used herein, the term entrainment is intended broadly to refer to the drawing in and transportation of particles or other material in fluid flow. For example, a pad conditioner such as conditioner 228 is often used for slurry entrainment.

Referring now to FIG. 3, it is a simplified perspective view of an exemplary linearly reciprocating or directional polisher 300 with a polishing member 100 according to a first presently preferred embodiment. The directional polisher 300 includes the polishing member 100, the wafer holder 204, the wafer holder axle 202, a movable table 320, a table support 222, and a base 324 that serves as a housing for the table support 222. The polishing member 100, as described above, includes a polishing pad 108, a stiffening layer 112, and a backing layer 116. As in FIG. 2, the wafer holder 204 is configured to hold a wafer 206. The movable table 320 is in contact with the polishing member 100 and supports the polishing member 100. Preferably, the movable table 320 is attached to or is in immediate contact with the backing layer 116 of the polishing member 100. Typically, the surface area of the movable table 320 exceeds the surface area of the wafer holder 204.

The operation of the linearly reciprocating polisher 300 of FIG. 3 is similar to that of the rotary polisher 200 of FIG. 3, except that the movable table 320 in FIG. 3 is preferably linearly reciprocating, and is configured to move back and forth in a linear direction.

Of course, it should be understood that the rotary polisher 200 of FIG. 2 and the linearly reciprocating polisher 300 of FIG. 3 are examples of presently preferred embodiments. Of course, dispensers and pad conditioners may be suspended over a polishing member 100 in a linearly reciprocating polisher. Or, for example, a rotary polisher can include the polishing member 300 without utilizing a dispenser or a pad conditioner. In other embodiments, for example, a slurry may be dispensed through the polishing member 300 itself. Accordingly, the polishing member 300 may be fabricated with holes to facilitate dispensing slurry through the polishing member 300.

Figure 4:
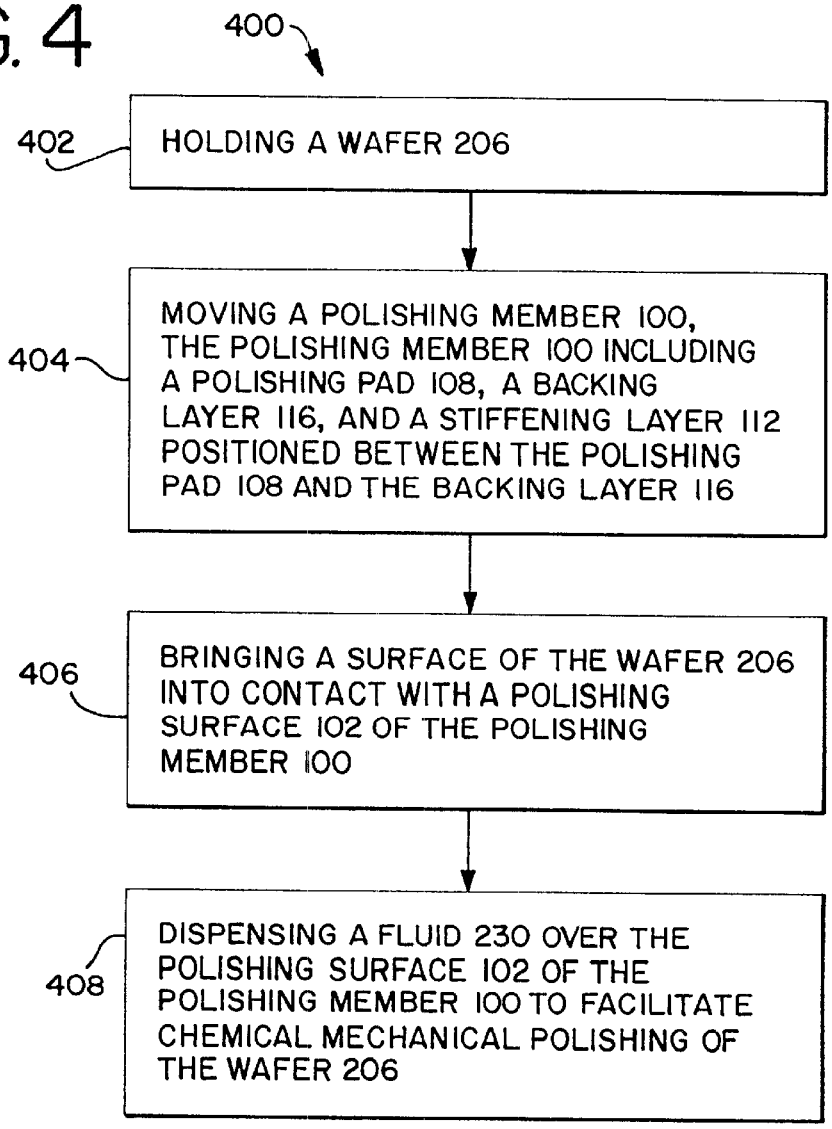
FIG. 4 is a flow chart of a method of performing chemical mechanical polishing/planarization on a wafer according to a presently preferred embodiment.

Referring to FIG. 4, it is a flow chart of a method 400 of performing chemical mechanical polishing/planarization on a wafer 206 according to a presently preferred embodiment. The method includes a series of acts that can be performed in any order consistent with the acts.

In act 402, the wafer 206 is held. Preferably, the wafer 206 is held by the wafer holder 204 of FIGS. 2 and 3.

In act 404, a polishing member 100 is moved. The polishing member 100 includes a polishing pad 108, a backing layer 116, and a stiffening layer 112 according to any of FIGS. 1–3. The stiffening layer 112 is positioned between the polishing pad 108 and the backing layer 116. In a preferred embodiment according to FIG. 2, for example, the act 404 of moving the polishing member 100 includes rotating the polishing member 100. In this embodiment, the polishing member 100 is preferably rotated in the presence of a fluid 230. Preferably, the fluid 230 includes abrasives contained in a chemical slurry. In a preferred embodiment according to FIG. 3, for example, the act 404 of moving the polishing member 100 includes moving the polishing member 100 back and forth in a linear direction.

In act 406, a surface of the wafer 206 is brought into contact with a polishing surface 102 of the polishing member 100.

Preferably, in act 408, a fluid 230 is dispensed over the polishing surface 102 of the polishing member 100 to facilitate chemical mechanical polishing of the wafer 206.

Wafer polishing apparatuses and methods have been described herein with reference to chemical mechanical polishing/planarization. Of course, the polishing member 100 of FIG. 1 and the embodiments presented herein may be utilized in a variety of processes and applications. For example, the polishing member 100 can be utilized in performing lapping or polishing processes with minimum to negligible surface chemical activity.

A variety of presently preferred and exemplary embodiments are presented, each including a stiffening layer. Of course, other embodiments and arrangements are possible, other than these illustrative examples.

During a conventional wafer planarization process in which a planarization member such as a polisher is pressed down (or up) on a wafer, the polisher exerts less pressure on the center of the wafer than on the edges of the wafer. What typically results is a radial gradient in material removal rate over the surface of the wafer. An additional challenge of typical wafer planarization processes when performed on a wafer is that a planarization member such as a polisher exhibits excessive surface conformity to localized areas of the wafer. These challenges can result in less than optimal planarization and polish uniformity over the surface of the wafer.

An advantage of the presently preferred and exemplary embodiments is that a polishing member having a stiffening layer is provided to reduce the radial gradient in material removal rate over the surface of the wafer. An additional advantage of the presently preferred and exemplary embodiments is that a polishing member having a stiffening layer and a polishing surface is provided that opposes the tendency of the polishing surface to conform to localized areas on the wafer, thus maintaining the planarity of the polishing surface. Ultimately, the presently preferred and exemplary embodiments described herein present an improved compromise between global planarization and polish uniformity of the wafer surface.

The stiffening layer as sandwiched by a polishing pad and a soft material or backing layer presents a rigid polishing member having an elastic foundation. That is, the polishing surface of the polishing member produces global planarization of the wafer surface by conforming less to localized areas due to the stiffening layer, but exhibits overall compliance due to the elastic foundation provided by the backing layer, thereby giving uniform polish across the wafer. In this way, the presently preferred embodiments compromise between stiffness and compliance of the polishing surface of the polishing pad and the polishing member.

It should be understood that the figures are not drawn to scale in all instances and depict simplified representations of exemplary polishing devices with many functional characteristics well-known to those skilled in the art.

As used herein, the term wafer is intended broadly to refer to any variety of precision elements onto which integrated circuit layers can be fabricated and that can undergo planarization and polishing according to any variety of the presently preferred embodiments. For example, the wafer will typically be a semiconductor wafer, although the methods and apparatuses described herein can be applied to other materials.

As used herein, the term compliance is intended broadly to refer to a material property or component characteristic resulting in deformation in the direction of loading when subject to an applied stress, whether the primary condition of deformation is material compression or bending. Generally speaking, for a given applied stress, the greater the material compliance, the greater the deformation. It should be understood that the compliance may be measured through a variety of methods or likewise be determined through more commonly tabulated indicators of material stiffness including, but not being limited to, modulus of elasticity or hardness. Furthermore, the term compliance refers to the combined effects of material properties and component physical dimensions, which impact the amount of deflection experience for a given level of applied stress.

The phrase coupled with, as used herein, means coupled either directly or indirectly via one or more intervening elements. The phrase attached to, as used herein, means attached either directly or indirectly via one or more intervening elements.

From the foregoing, a method for performing and an apparatus to perform chemical mechanical polishing on a semiconductor wafer have been described. The apparatus includes a wafer holder, a polishing member, and a movable table. The movable table is in contact with and is supporting the polishing member. The polishing member includes a polishing pad, a backing layer, and a stiffening layer positioned between the backing layer and the polishing pad. The polishing pad has a polishing surface that is oriented to receive a semiconductor wafer held by the wafer holder. The polishing surface is configured to chemically mechanically polish the semiconductor wafer. The method includes holding a semiconductor wafer, moving a polishing member, and bringing a surface of the semiconductor wafer into contact with the polishing member. The polishing member includes a polishing pad, a backing layer, and a stiffening layer positioned between the polishing pad and the backing layer.

It is to be understood that a wide range of changes and modifications to the embodiments described above are contemplated and will be apparent to those skilled in the art. It is therefore intended that the foregoing detailed description be regarded as illustrative rather than limiting, and that it be understood that the following claims, including all equivalents, are intended to define the spirit and scope of this invention.

I claim:

1. A polishing member to perform chemical mechanical polishing on a wafer, comprising:

a polishing pad having a polishing surface and a back side;

a uniform, continuous stiffening layer having a first side and a second side, the first side attached to the back side of said polishing pad; and a backing layer having a front side, the front side attached to the second side of said stiffening layer; and wherein the polishing surface of said polishing pad rotates against a surface of a wafer to remove impurities and materials on the surface of the wafer and to planarize the surface of the wafer while approaching a uniform polish over the surface of the wafer.

2. The polishing member of claim 1, wherein the wafer comprises a semiconductor wafer.

3. The polishing member of claim 1, wherein said polishing pad, said stiffening layer, and said backing layer are molded together to form a unitary piece.

4. The polishing member of claim 1, wherein the first side of said stiffening layer is attached to the back side of said polishing pad with a first adhesive and the front side of said backing layer is attached to the second side of said stiffening layer with a second adhesive.

5. The polishing member of claim 4, wherein the first adhesive is a different adhesive compound than the second adhesive.

6. The polishing member of claim 4, wherein said polishing pad and the first adhesive form a unitary piece.

7. The polishing member of claim 4, wherein said backing layer, the second adhesive, and said stiffening layer form a unitary piece.

8. The polishing member of claim 1, wherein a compliance of said backing layer exceeds a compliance of said stiffening layer.

9. The polishing member of claim 1, wherein a compliance of said backing layer exceeds a compliance of said polishing pad.

10. The polishing member of claim 9, wherein a compliance of said polishing pad exceeds a compliance of said stiffening layer.

11. The polishing member of claim 1, wherein a compliance of said polishing pad exceeds a compliance of said stiffening layer.

12. An apparatus to perform chemical mechanical polishing on a wafer, comprising:

a wafer holder;

a polishing member, said polishing member comprising:

a polishing pad, said polishing pad having a polishing surface, the polishing surface being oriented to receive a wafer held by said wafer holder and being configured to chemically mechanically polish the wafer;

a backing layer a uniform, continuous stiffening layer positioned between said polishing pad and said backing layer; and a movable table in contact with and supporting said polishing member.

13. The apparatus of claim 12, wherein the surface area of said table exceeds the surface area of said wafer holder.

14. The apparatus of claim 12, wherein the movable table is rotary.

15. The apparatus of claim 14, wherein the movable table is rotary and has an axis of rotation removed from the center of the table.

16. The apparatus of claim 12, wherein the movable table is linearly reciprocating.

17. The apparatus of claim 12, wherein abrasives contained in a chemical slurry are utilized to chemically mechanically polish the wafer.

18. The apparatus of claim 12, further comprising:

a dispenser, said dispenser suspended proximally to the polishing surface of said polishing pad to distribute a fluid over the polishing surface to facilitate chemical mechanical polishing of the wafer.

19. The apparatus of claim 18 further comprising:

a pad conditioner, said pad conditioner suspended proximally to the polishing surface of said polishing pad and to condition the polishing surface for improved fluid entrainment.

20. The apparatus of claim 18, wherein the fluid is substantially non-abrasive.

21. The apparatus of claim 20, wherein said polishing pad having the polishing surface comprises a fixed abrasive.

22. The apparatus of claim 18 wherein the fluid comprises abrasives contained in a chemical slurry.

23. The apparatus of claim 22, wherein the polishing surface of said polishing pad is substantially non-abrasive.

24. The apparatus of claim 12, wherein the polishing surface requires application of a substantially non-abrasive fluid to abrade the polishing surface to facilitate chemical mechanical polishing of the wafer.

25. An apparatus to perform chemical mechanical polishing on a wafer, comprising:

a wafer holder;

a polishing pad, said polishing pad having a polishing surface, the polishing surface being oriented to receive a wafer held by said wafer holder and being configured to chemically mechanically polish the wafer;

a backing layer a uniform, continuous stiffening layer positioned between said polishing pad and said backing layer; and a movable table in contact with and supporting said backing layer.

26. A method of performing chemical mechanical polishing on a wafer, the method comprising:

holding a wafer;

moving a polishing member, the polishing member comprising a polishing pad, a backing layer, and a uniform, continuous stiffening layer positioned between the polishing pad and said backing layer; and bringing a surface of the wafer into contact with a polishing surface of the polishing member.

27. The method of claim 26, wherein the act of moving the polishing member comprises rotating the polishing member.

28. The method of claim 27, wherein the polishing member is rotated in the presence of abrasives contained in a chemical slurry.

29. The method of claim 27, further comprising:

dispensing a fluid over the polishing surface of the polishing member to facilitate chemical mechanical polishing of the wafer.

30. The method of claim 26, wherein the act of moving the polishing member comprises moving the polishing member back and forth in a linear direction.

31. An apparatus to perform chemical mechanical polishing on a wafer, comprising:

a wafer holder;

a polishing pad, said polishing pad having a fixed abrasive polishing surface, the polishing surface being oriented to receive a wafer held by said wafer holder and being configured to chemically mechanically polish the wafer;

a backing layer a stiffening layer positioned between said polishing pad and said backing layer; and a movable table in contact with and supporting said backing layer.

32. The apparatus of claim 31, further comprising:

a dispenser, said dispenser suspended proximally to the polishing surface of the polishing pad to distribute a fluid over the polishing surface to facilitate chemical mechanical polishing of the wafer, wherein the fluid is substantially non-abrasive.

* * * * *

UNITED STATES PATENT AND TRADEMARK OFFICE

CERTIFICATE OF CORRECTION

PATENT NO. : 6,402,591 B1
DATED : June 11, 2002
INVENTOR(S) : Brian Thornton

It is certified that error appears in the above-identified patent and that said Letters Patent is hereby corrected as shown below:

Column 9,
Line 32, immediately after "layer" insert -- ; -- (semicolon).

Column 10,
Lines 14 and 49, immediately after "layer" insert -- ; -- (semicolon).

Signed and Sealed this

Eighteenth Day of February, 2003

JAMES E. ROGAN
*Director of the United States Patent and Trademark Office*